US008210314B1

(12) United States Patent
Polak

(10) Patent No.: US 8,210,314 B1
(45) Date of Patent: Jul. 3, 2012

(54) LEG-LENGTH ADJUSTMENT ASSEMBLY AND USES THEREOF

(76) Inventor: Rex J. Polak, Loysville, PA (US)

( * ) Notice: Subject to any disclaimer, the term of this patent is extended or adjusted under 35 U.S.C. 154(b) by 514 days.

(21) Appl. No.: 12/319,182

(22) Filed: Jan. 2, 2009

(51) Int. Cl.
*E06C 7/44* (2006.01)

(52) U.S. Cl. ..... 182/201; 248/188.5; 248/410

(58) Field of Classification Search ..... 182/201, 182/202, 204; 248/410, 297.51, 188.5
See application file for complete search history.

(56) References Cited

U.S. PATENT DOCUMENTS 836,303 A * 11/1906 Christiansen ..... 188/67
2,051,969 A * 8/1936 Shastock ..... 403/105
2,849,204 A * 8/1958 Petrick et al. ..... 248/410
2,911,134 A * 11/1959 Derby et al. ..... 182/201
2,914,135 A * 11/1959 Crouch Elmer A ..... 182/201
3,021,921 A * 2/1962 Poelvoorde et al. ..... 182/201
3,539,142 A * 11/1970 Morand ..... 248/230.2
4,073,367 A * 2/1978 Wright ..... 182/204
4,766,976 A * 8/1988 Wallick, Jr. ..... 182/201
5,027,923 A * 7/1991 Derome ..... 182/201
5,526,898 A * 6/1996 Clark ..... 182/200
6,619,602 B2 * 9/2003 Stevenson ..... 248/188.8
7,611,104 B1 * 11/2009 Gifford, Sr. ..... 248/176.3

* cited by examiner

*Primary Examiner* — Blair M. Johnson
(74) *Attorney, Agent, or Firm* — David J. Wilson

(57) ABSTRACT

The present invention is related to a new and non-obvious device for adjusting the length of a leg associated with, for example a ladder, tripod or the like. Prior art leg adjustment devices are not without their problems being either extremely complicated and, therefore, expensive to build or difficult to use, heavy or limited to specific adjustment lengths.

15 Claims, 8 Drawing Sheets

LEG-LENGTH ADJUSTMENT ASSEMBLY AND USES THEREOF

BACKGROUND OF INVENTION

Prior art leg adjustment devices are not without their problems being either extremely complicated and, therefore, expensive to build or difficult to use, heavy or limited to specific adjustment lengths.

A search of the prior art did not disclose any patents that read directly on the claims of the present invention or that rendered the present invention obvious or predictable, however, several references, pertaining mainly to adjustment attachments for conventional ladders, were considered related.

U.S. Pat. No. 5,577,574, issued in the name of Joseph. The Joseph patent discloses an adjustable stepladder that incorporates the use of four telescoping legs to allow the user to place the ladder on uneven surfaces. Each adjustable leg employs locking pins held by springs to lock the leg in the desired position, the intent being to allow the user to place the ladder on uneven surfaces. This device, however, suffers from several problems that not only make ineffective in achieving its purpose, but also present inherent dangers to the user. It is obvious from the disclosure that the spacing of the adjustment apertures is far too large to ensure its safe operation. The result of this spacing is such that proper ladder adjustment, in many situations, would be difficult if not impossible to achieve. In the commonly occurring case where the adjustment distance required is slight, adjustment of the ladder legs could result in a more uneven ladder orientation than if it was placed on the surface without adjustment. Also, because of these problems, it will often be the case where the user must select between two or more ladder configurations, each of which presenting an uneven ladder orientation, without being able to determine which, if any, are safe to use. However, there are no provisions in the Joseph disclosure for any devices that would indicate a safe or proper ladder orientation.

Two patents disclose self-leveling ladder constructions for dual-rail type ladder designs: U.S. Pat. No. 4,627,516, issued in the name of Studer, discloses an automatic, self-leveling ladder which adjusts itself and locks to accommodate an uneven surface. The device incorporates coil springs and stub shaft gears which are automatically engaged by the weight of the ladder in order to lock the legs in a level position. U.S. Pat. No. 4,497,390, issued in the name of Wilson, discloses a self-adjusting ladder wherein sliding legs are physically linked to one another by a series of steel balls contained in a flexible tube. The balls transfer the force from one leg of the ladder to the other so that when the bottom of a leg is met with an uneven surface, the ladder will automatically level itself. The Wilson inventions suffers from an obvious problem wherein there is no means by which to lock the legs in position once adjusted to the proper level. This creates an extremely dangerous situation where the shifting of weight upon the ladder would cause the legs to react and possibly result in the ladder tipping over. The Studer invention, while providing a leg locking means, is complex in design will most likely be too expensive to successfully produce. Also, it is apparent from these disclosures that the displacement of the adjustable legs is not sufficient to accommodate a large slope, as would be the case where the user desires to use the ladder on surfaces such as stairs or the like. Furthermore, neither of these disclosures anticipate the use of any devices that would indicate a safe or proper ladder orientation, nor do they address the need to provide leveling capabilities to a stepladder-type device.

Several patents disclose ladder leveling attachments of varying designs for use with dual-rail type ladder designs wherein both legs are fit with telescopically adjustable leg extensions: U.S. Pat. No. 5,669,462, issued in the name of Jennings, discloses an adjustable ladder that incorporates the use of telescoping leg extensions, attaching them to the ladder side rails to allow the user to place the ladder on uneven surfaces. Bolts and wing nuts are used to secure the leg extensions members to each side rail. U.S. Pat. No. 5,542,497, issued in the name of Macyszyn, discloses a ladder level adjusting attachment that incorporates a self-locking cam mechanism, attached to the side rail of the ladder, that locks a telescoping leg extension in place automatically when placed on an uneven surface. U.S. Pat. No. 5,107,958, issued in the name of Johnson, discloses an apparatus consisting of a pair of telescoping leg extension attachments. A threaded screw bolt functions along with a spring pin head to hold the leg extension in position via insertion through a ladder receiving sleeve. U.S. Pat. No. 4,844,208, issued in the name of Veness, discloses an attachment for a ladder whereby a wooden extension is secured to the leg of such ladder to accommodate uneven surfaces. The attachment comprises a metal channel which receives desired length of wood for forming a ladder leg extension. A pair of shafts extend through and between the walls of the metal channel. Pins project from one shaft to engage and retain the wooden extension. A handle, welded to the shaft, actuates the pins to engage and release the wooden extension. U.S. Pat. No. 3,414,082, issued in the name of Gilland, discloses a ladder leveling apparatus intended for use with metal ladders to accommodate uneven surfaces. The telescopic attachment consists of an extension mounting member adapted for pivotal attachment. It incorporates pivot bolts and wing-nuts to be inserted at selected positions. All of these devices are intended for use with dual-rung ladders and do not anticipate use with conventional stepladder designs. Also, it is apparent from many of these disclosures that the displacement of the adjustable legs is not sufficient to accommodate a large slope, as would be the case where the user desires to use the ladder on stairs or the like. In many of these devices, the adjustments are made in increments that may not adequately compensate for the surface slope, resulting in unsafe ladder positioning. Furthermore, none of these disclosures anticipate the use of any indicating devices that would aid the user in determining a safe or proper ladder orientation.

Several patents disclose ladder leveling attachments of varying designs for use with dual-rail type ladder designs wherein one of the legs is fit with a telescopically adjustable leg extension: U.S. Pat. No. 5,064,024, issued in the name of Barham, discloses a vertically adjustable ladder leg extender apparatus for attachment to a single leg of a ladder, extending the leg in order to accommodate uneven surfaces. The device consists of a sleeve that carries an extendible support leg which slides vertically therein. The support leg is vertically adjustable and secured in place by turn bolts. U.S. Pat. No. 5,027,923, issued in the name of Derome, discloses an attachment for a ladder which includes a housing with an extensible leg to allow use on an uneven surface. A locking mechanism is mounted in the housing and consists of a cam having a lobe which engages the extensible leg. The extensible leg is moved downward by an attached foot-step. A release lever is attached for retraction into the housing. The top of the housing has a bubble level to determine when ladder is level with respect to the direction of the ladder rungs. U.S. Pat. No. 4,802,471, issued in the name of Cordell, discloses an attachment for a ladder to accommodate uneven surfaces. The attachment consists of a T-shaped gripping device with a sharp edge that makes contact with a smooth slidable rail, locking the rail into the desired position. The slidable rail extends the ladder leg, thus leveling it. Pressure is applied to the gripping device to remove contact between it and the smooth rail thus allowing the rail to have an infinite number of positions being limited only by the length of such smooth rail. An infinite number of positions are possible because a smooth surface is utilized rather than ratchets. U.S. Pat. No. 4,766,976, issued in the name of Wallick, Jr., discloses an attachment for a ladder to accommodate uneven surfaces. The apparatus provides a ladder leg extender and leveler consisting of a longitudinally extending frame structure that is attached, in a face-to-face relation to a ladder leg side. The apparatus avoids undesirable bending stresses that have formerly been placed on the rung fasteners by employing a base leg recess. The apparatus incorporates a hollow longitudinal extension leg which slides through apertures and a ball and socket arrangement to level the ladder. The apparatus further employs a number of stacked annular clamp plates and a helical spring to lock the extension leg in the desired position. U.S. Pat. No. 5,615,752, issued in the name of Wassil, discloses a ladder-leveling platform assembly in which such platform can be adjusted to accommodate an uneven surface. The assembly consists of a base with a pivotable plate that is supported on a platform. Elevation is accomplished by the use of rods that are used to maintain a plate which is joined to an axle along with a series of apertures inclined to elevate the ladder leg to a desired position. The plate receives one ladder leg. None of these leveling devices can be used in conjunction with a conventional stepladder design due to the fact that they all are intended to be placed on a single leg of a dual-rail type ladder design. Since stepladders have four legs, use of these devices would result in extremely unstable ladder positioning, creating the potential for injury. Also, it is apparent from many of these disclosures that the displacement of the adjustable legs is not sufficient to accommodate a large slope, as would be the case where the user desires to use the ladder on stairs or the like. In many of these devices, the adjustments are made in increments that may not adequately compensate for the surface slope, resulting in unsafe ladder positioning. Although the Derome device anticipates the use of a bubble level to indicate proper position indication, it fails to take into consideration the fact that a stepladder requires two-dimensional leveling, both parallel and perpendicular to the ladder rungs.

U.S. Pat. No. 6,779,632 to Parks, III, discloses another leg adjustment device using bolts that extend through a dual-rail design. This design would require tools to adjust the length of the legs, have parts that could be lost and take unnecessary time to adjust causing users to not adjust the legs and endanger themselves by, for example, over reaching.

U.S. Pat. No. 6,595,326 to Dean discloses a very complicated device for adjusting the length of ladder legs. In addition to being overly complicated the device is limited to specific adjustment lengths.

U.S. Pat. No. 6,401,866 to Roy discloses a complicated ratchet-type device for adjusting the legs of ladders. Such devices are expensive to make and also are limited to specific adjustment lengths.

U.S. Pat. No. 5,526,898 to Clark discloses a leg extension assembly that uses a dual-rail system wherein the lower rail is raised and lowered by a turn screw. This device suffers from being overly complicated and difficult and time consuming to use.

What is needed is a leg adjustment device for use in ladders and the like that is inexpensive to make, easy to use and permits the adjustment of the leg member to any position within the lower and upper limits of the adjustment range.

SUMMARY OF INVENTION

In one aspect, the invention relates to a device for adjusting the leg-length of leg assemblies that may be attached to, for example, a ladder or tripod.

The present device is a novel and non-obvious improvement over the devices known to one of skill in the art. In this regard, the present device comprises a leg adjustment mechanism wherein a tubular inner member is slidably positioned within an outer member. The inner tubular member is positioned within the outer member by one or more glides. The glides may also comprise bushings to help the tubular member slide in the glides. The bushings may be made of any smooth or slippery material such a nylon (and other plastics), brass, bronze, carbon (i.e., graphite), etc.

The lower end of the tubular member may be attached to a foot. The foot would ensure good contact with the surface upon which the adjustable leg extension may be placed. The foot may pivot at the end of the tubular member and may also comprise a non-skid surface on the portion of the foot that contacts the surface upon which the adjustable leg extension may be placed.

The tubular member would further be positioned such that it passed through a hole in locking member within the outer member. The hole would, in one embodiment, by oval or elliptical One end of the locking member would extend out through an opening in the outer member. The locking member would be able to pivot on a pivot point just inside the lower edge of the opening in the outer member. The second end of the locking member would be indirectly connected to the inside of the outer member at a point on the opposite side of the outer member and below the level of the bottom edge of the opening in the outer member. The connection would be via a spring. The other end of the spring would connect to the locking member at a point at or proximal to the end of the locking member. When contracted, the spring would position and hold the locking member such that substantially the entire edge of the elliptical hole in the locking member would be in contact with the tubular member and thereby prevent the tubular member from moving or slipping.

To reposition the tubular member within the outer member and thereby extend or shorten the leg member the user would press down on the portion of the locking member that extends out of the opening of the outer member. This would cause the spring to expand and also cause the elliptical hole in the locking member to substantially de-contact the tubular member. Once the elliptical hole of the locking member is no longer in substantial contact with the tubular member, the tubular member will the be free for the user to reposition as needed. When the user released pressure on the portion of the locking member that extends out of the opening in the outer member the spring would contract and the elliptical hole in the locking member would once again make substantial contact with the tubular member and prevent the tubular member from moving or slipping.

One of skill in the art will understand that the present invention may also be constructed such that pressing up on the portion of the locking member extending out of the opening in the outer member would permit repositioning of the tubular member. To do this one merely need to position the pivot point above the opening in the outer member and have the attachment point of the spring on the inside of the outer member placed above the locking member.

In another embodiment, the leg extension device of the present invention may also comprise a means to assist the extension of the leg. In this regard, the device would additionally comprise one or more springs wherein one end of the spring would be attached proximal to the lower end of the outer member and the other end of the spring would be attached to the tubular member at a position below where the tubular member passes through the hole in the locking member. When the user pressed on the locking member to permit the movement of the tubular member through the elliptical hole in the locking member, the spring(s) would contract and thereby cause the tubular member to extend from the outer member. To shorten the leg the user would only need to apply enough force to the end of the tubular member to cause the springs to extend and the tubular member to slide into the outer member. The leg would then be locked into the new position when the user released the locking member. In yet another embodiment, the springs may be positioned to cause the leg to shorten when the user presses the locking member. To extend the leg the user would only need to, for example, step on the foot of the tubular member while pulling on the outer member. The leg would then be locked into the new position when the user released the locking member.

In one non-limiting embodiment, the present invention contemplates a leg-length adjustment assembly which comprises an outer member comprising an inner surface and one or more openings in the wall of the outer member said opening comprising upper, lower and side edges; an inner tubular member disposed within said outer member wherein said inner tubular member does not come into contact with said outer member; a pivotal locking member comprising an outer end, an inner end, and a pivot point, wherein said inner tubular member passes through an elliptical hole comprising an edge in the pivotal locking member, wherein said outer end of said locking member extends through the opening of said outer member, and wherein said the pivot point of the pivotal locking member pivots on a pivot located within said outer member proximal to the lower edge of said opening of said opening; a spring having a first end and a second end, said first end attached at an attachment point at the inner end of said locking member and the second end attached to an attachment point located on the inner surface of the outer member; wherein when said outer end of said pivotal locking member is depressed the spring is expanded, the pivotal locking member is pivoted on said pivot, the elliptical hole in said pivotal locking member is positioned such that it is essentially perpendicular to said tubular member thereby allowing said inner tubular member to freely pass through said elliptical hole of the locking member, and wherein when said outer end of said pivotal locking member is released, the spring contracts, the pivotal locking member is pivoted on said pivot, the elliptical hole in said locking member is positioned such that it is at an angle to said tubular member and the edges of said elliptical hole at least partially contacts said tubular member thereby preventing the movement of the tubular member through the elliptical hole of the locking member.

In another embodiment, the leg-length adjustment assembly of the present invention additionally comprises guides for said tubular member that are positioned within said outer member below and/or above said pivotal locking member.

In yet another embodiment, the guides of the leg-length adjustment assembly of the present invention comprise bushings and said bushings contact said tubular member. In still yet another embodiment said bushings comprise or consist of neoprene.

In one non-limiting embodiment of the present invention the leg-adjustment assemblies of the present invention are used in the legs of an adjustable ladder wherein the adjustable ladder may comprising a plurality of leg assemblies selected from the group consisting of two legs and four legs.

In an other embodiment of the adjustable ladder of the present invention, each leg assembly additionally may optionally comprise a pivotal foot and said pivotal foot may optionally comprises a bottom surface and a non-slip surface on said bottom surface.

In another embodiment of the present invention, the leg-adjustment assembly and/or the adjustable ladder of the present invention comprises materials selected from the group consisting of metal, plastic, rubber and wood.

In another embodiment of the present invention the adjustable ladder additionally comprises one or more means to determine if the ladder is level. Such means may be any leveling device known to those of skill in the art such as, but not limited to, bubble-type levels.

In another embodiment of the present invention, the leg-length adjustment assembly (weather used in a ladder or for another use), further comprises: one or more springs for extending the tubular member, each spring comprising a first end and a second end wherein the first end is attached to the tubular member below the pivotal locking member and the second end is attached to the inside of the outer member proximal to the lowest end of the outer member, wherein when the pivotal locking member is depressed, the spring contracts thereby causing the tubular member to slidably extend from the outer member, and when the pivotal locking member is depressed and upward pressure is applied to the foot of said tubular member, the tubular member is caused to slidably insert into said outer member.

In one non-limiting embodiment, the present invention contemplates an adjustable ladder comprising two or more leg-length adjustment assemblies comprising, each comprising an outer member comprising an inner surface and one or more openings in the wall of the outer member said opening comprising upper, lower and side edges; an inner tubular member disposed within said outer member wherein said inner tubular member does not come into contact with said outer member; a pivotal locking member comprising an outer end, an inner end, and a pivot point, wherein said inner tubular member passes through an elliptical hole comprising an edge in the pivotal locking member, wherein said outer end of said locking member extends through the opening of said outer member, and wherein said the pivot point of the pivotal locking member pivots on a pivot located within said outer member proximal to the lower edge of said opening of said opening; a spring having a first end and a second end, said first end attached at an attachment point at the inner end of said locking member and the second end attached to an attachment point located on the inner surface of the outer member; wherein when said outer end of said pivotal locking member is depressed the spring is expanded, the pivotal locking member is pivoted on said pivot, the elliptical hole in said pivotal locking member is positioned such that it is essentially perpendicular to said tubular member thereby allowing said inner tubular member to freely pass through said elliptical hole of the locking member, and wherein when said outer end of said pivotal locking member is released, the spring contracts, the pivotal locking member is pivoted on said pivot, the elliptical hole in said locking member is positioned such that it is at an angle to said tubular member and the edges of said elliptical hole at least partially contacts said tubular member thereby preventing the movement of the tubular member through the elliptical hole of the locking member; wherein the leg-length adjustment assembly further comprises one or more springs for extending said tubular member, each spring comprising a first end and a second end wherein said first end in attached to the tubular member below the pivotal locking member and the second end is attached to the inside of the outer member proximal to the lowest end of the outer member, wherein when the pivotal locking member is depressed, the spring contracts thereby causing the tubular member to slidably extend from the outer member, and when the pivotal locking member is depressed and upward pressure is applied to the foot of said tubular member, the tubular member is caused to slidably insert into the outer member; and, wherein each leg-length adjustment assemblies additionally comprises a pivotal foot wherein the pivotal foot comprises a bottom surface and a non-slip surface on the bottom surface; and, wherein the adjustable ladder additionally comprises one or more means to determine if level said ladder is level.

In another embodiment the present invention further contemplates that the guides for the tubular member are positioned within the outer member below the pivotal locking member.

In another embodiment the present invention further contemplates that the guides comprise bushings and the bushings contact the tubular member and that the bushings comprise neoprene.

In another embodiment the present invention further contemplates that the adjustable ladder comprises materials selected from the group consisting of metal, plastic, rubber and wood.

Other features and advantages of the invention will be apparent from the following description.

BRIEF DESCRIPTION OF DRAWINGS

FIGS. 7 (A & B) shows one non-limiting embodiment of a spring driven mechanism that assists in extending the tubular member from the outer member.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

Figure 1:
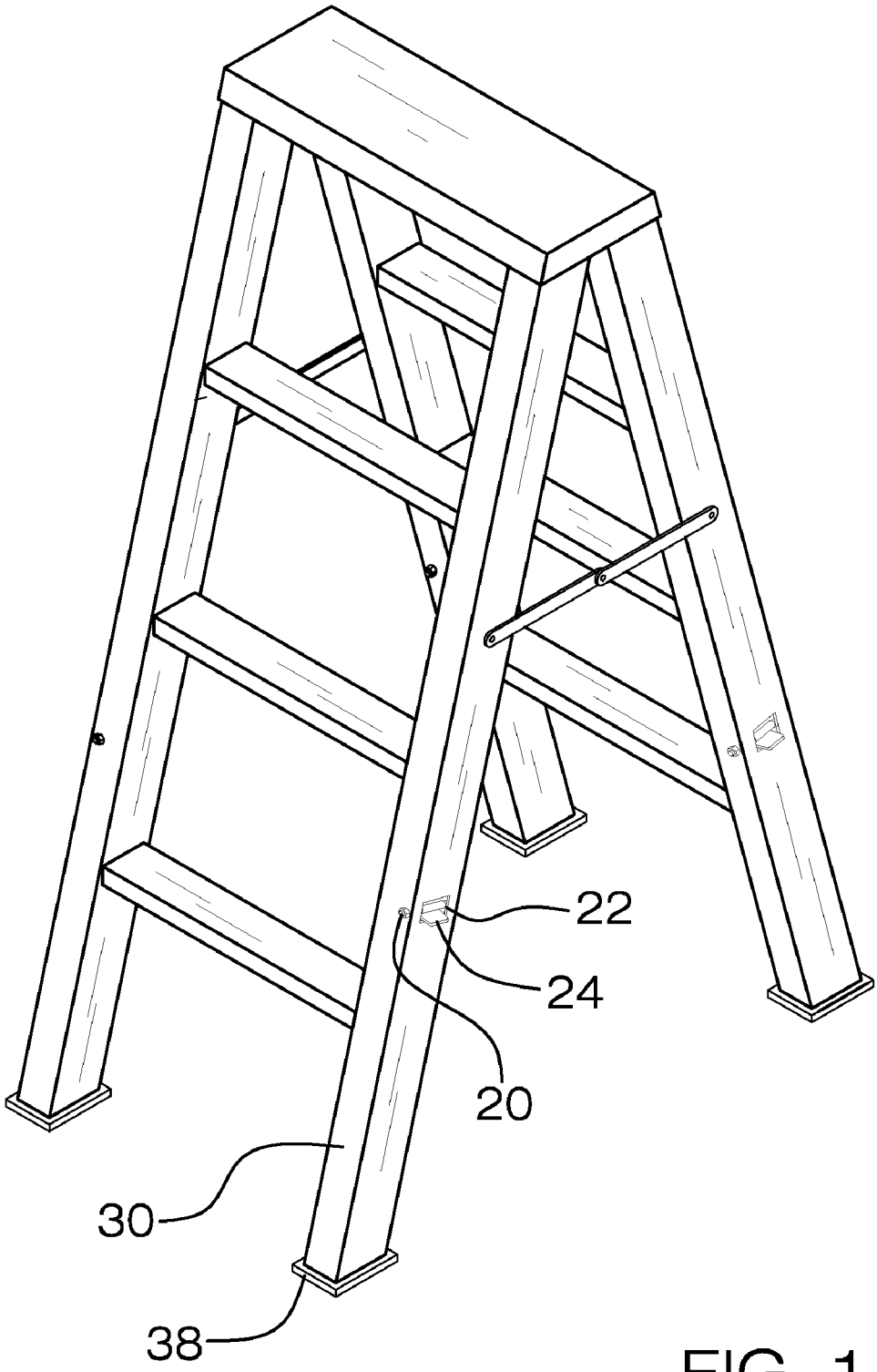
FIG. 1 shows a step-ladder comprising the leg-length adjustment assembly in each leg.

FIG. 1 shows one embodiment of the present invention wherein the leg extension assembly of the present invention is used in the legs of a step ladder. The locking member 24 can be seen extending from the opening 22 in the outer member 30. The pivot point 20 is also visible as is the foot member 38 that is attached to the tubular member (not visible).

Figure 2:
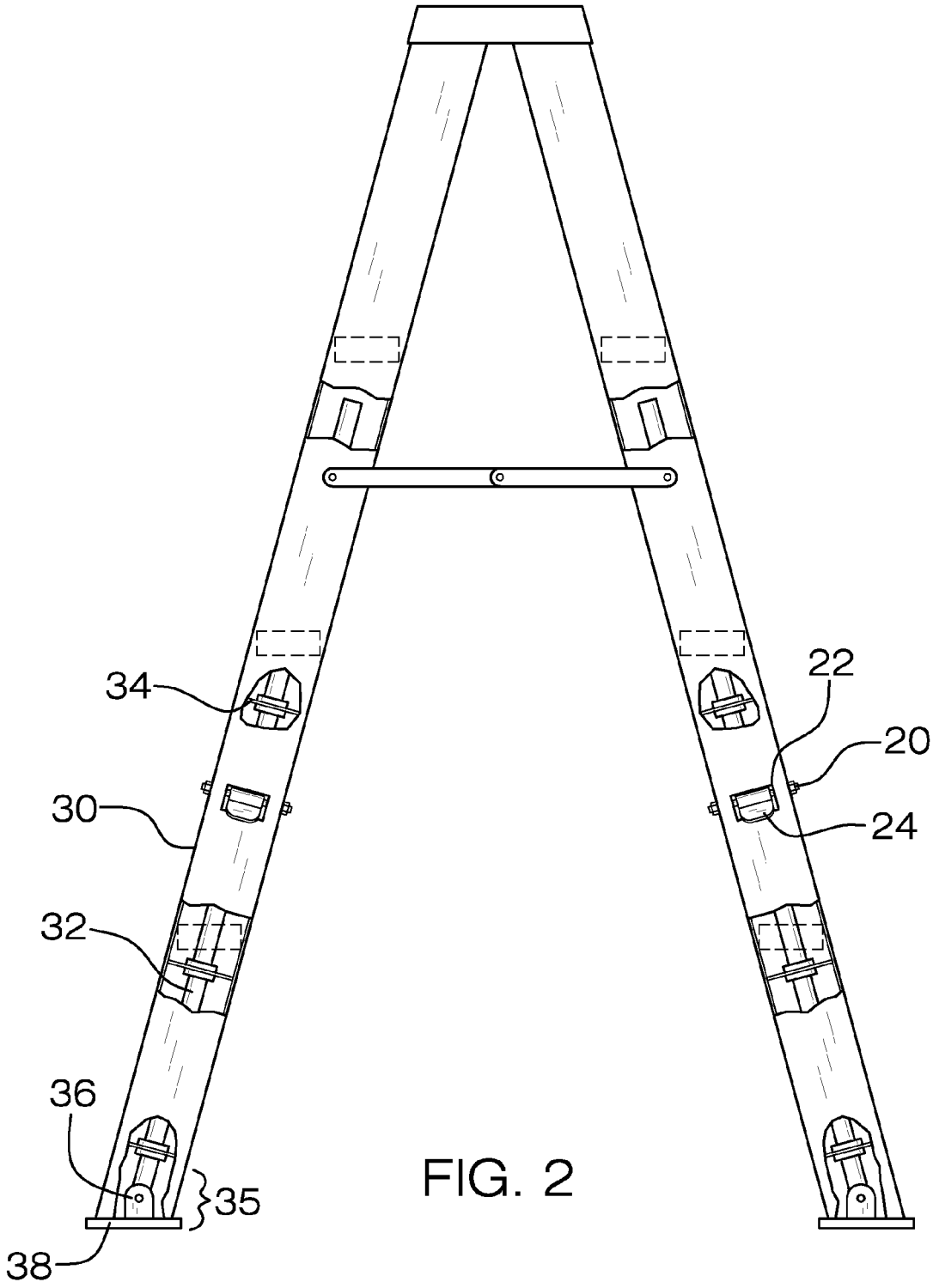
FIG. 2 shows the ladder of FIG. 1, wherein portions of the outer member of the legs is cut-away to permit the visualization of the workings of one embodiment of the device.

FIG. 2 shows a side view of the step ladder embodiment of FIG. 1 with cut-away sections to permit visualization of internal structures. The tubular member 32 is visible within the outer member 30. The tubular member 32 can be seen passing through glides 34. Also visible is the foot assembly 35 comprising the non-skid surface 38 and pivoting attachment point 36 where the foot is attached to the tubular member 32.

Figure 3:
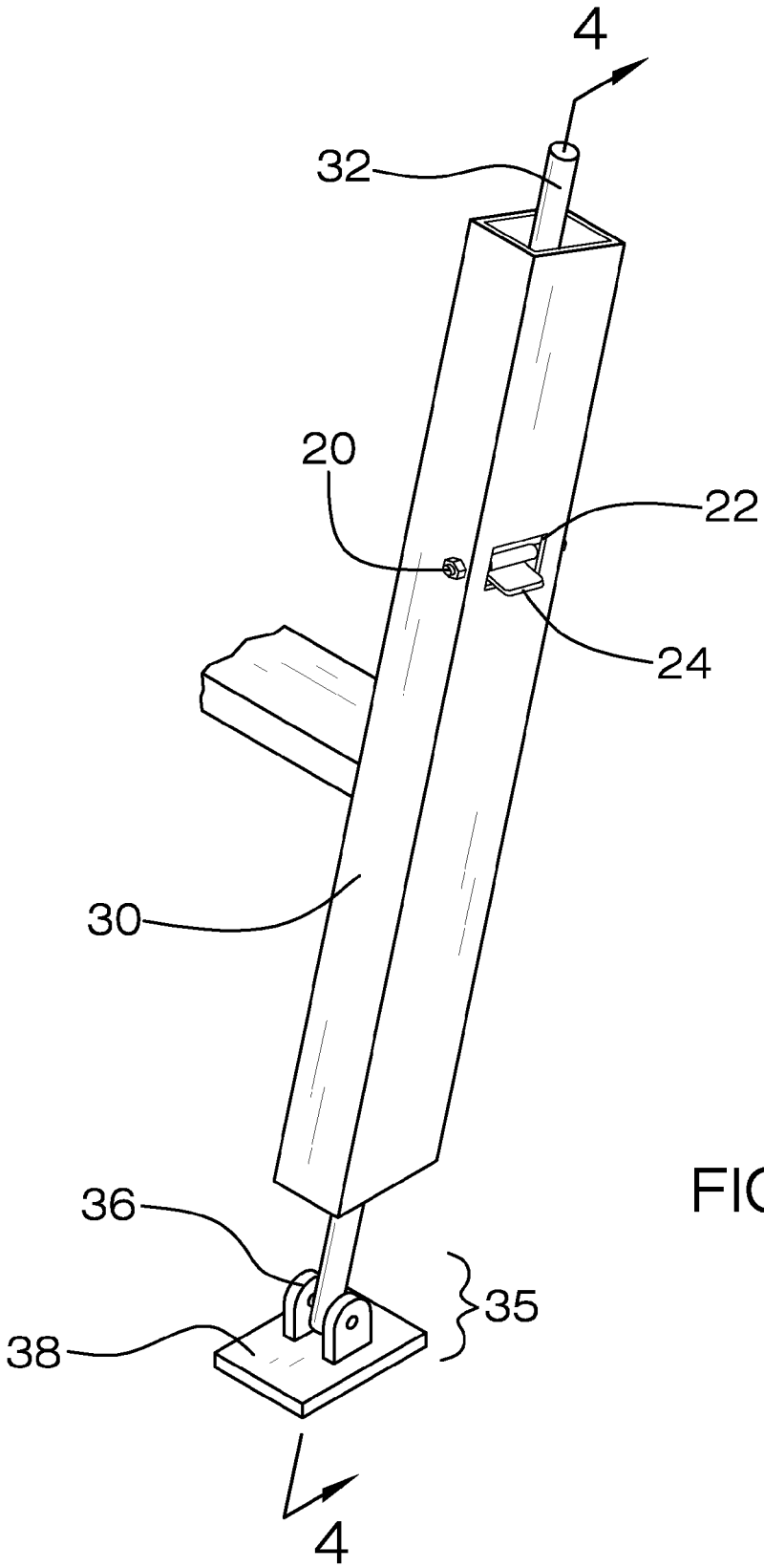
FIG. 3 shows a portion of a single leg of the step-ladder of claim 1.

FIG. 3 shows a single extendable leg assembly from the ladder exemplification of FIGS. 1 and 2. Visible are the outer member 30, the tubular member 32, the locking member 24, the opening 22 in the outer member, the pivot point 20, the foot assembly 35, the non-skid surface 38 of the foot assembly and the pivoting attachment point 36 of the foot assembly to the tubular member.

Figure 4:
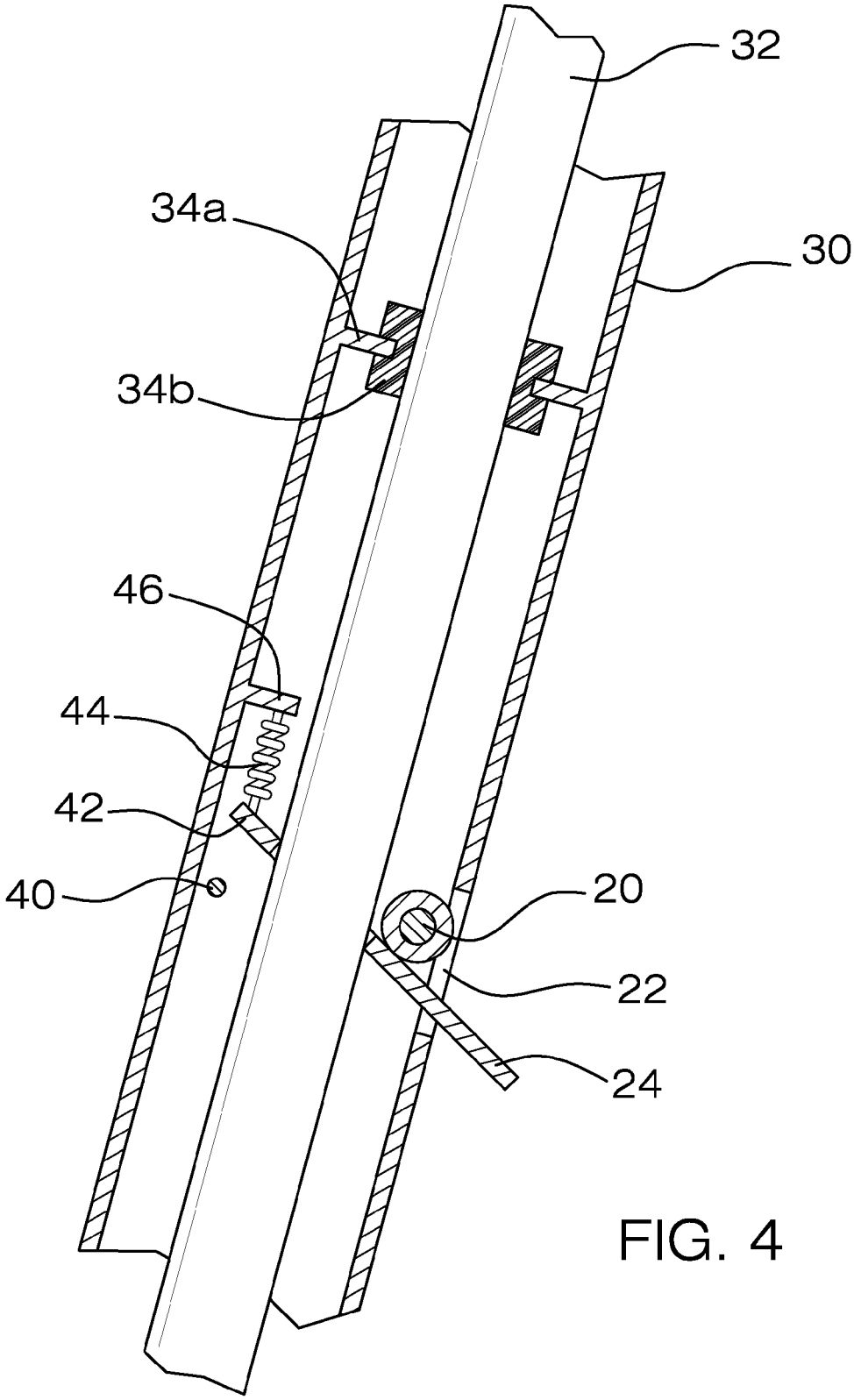
FIG. 4 shows a cross-section of the leg of FIG. 3 wherein details of one embodiment of the device can be seen.

FIG. 4 shows a cross sectional view of the leg extension assembly of the present invention. Visible in this figure are the glide 34*a* through which the tubular member 32 passes and the optional bushing 34*b*. Further, the figure shows the locking member 24 and associated spring 44 that holds the locking member in the locked position when the spring is contracted. The spring is attached proximal to the end 42 of the locking member that does not pass through the opening 22 in the outer member 30 and attached to the inside of the outer member 46, for example, as shown. Also visible is an optional stop 40 to ensure that the locking lever is not pressed to far by the user and bind the tubular member when trying to extend or contract the tubular member.

Figure 5:
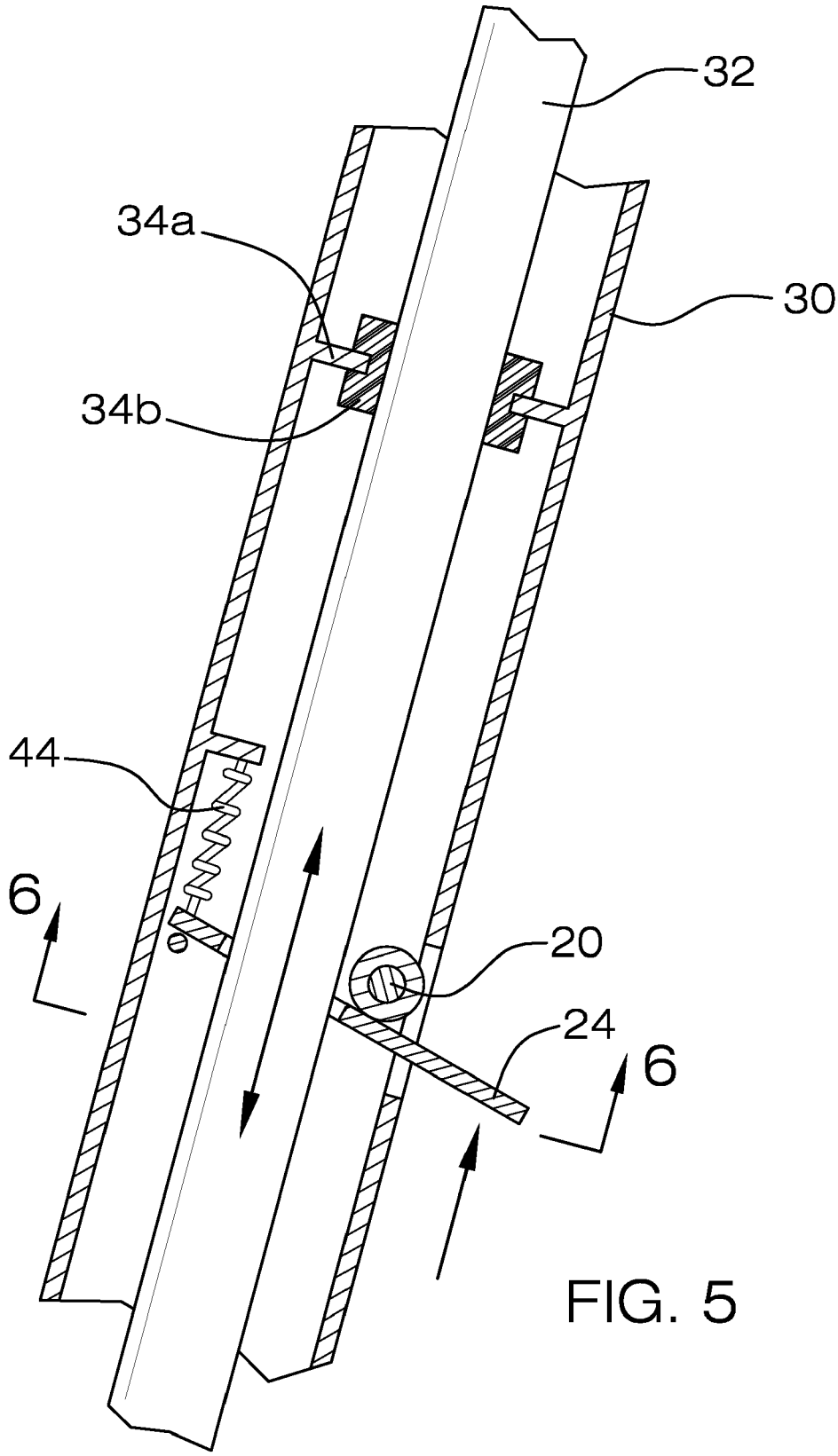
FIG. 5 shows one embodiment of how the device of the present invention can be operated.

FIG. 5 shows a cross sectional view of the leg extension assembly of the present invention as might look when the locking member 24 is pressed by the user (as indicated by the downward arrow above part no. 24). When the locking member 24 is pressed by the user the locking member pivots on the pivot point and the spring 44 expands (arrow). At this point the tubular member can be moved (slid) through the glides 34*a* & 34*b* to extend or shorten the length of the leg in the leg assembly of the present invention. Upon release of the locking member by the user the spring contracts thereby moving the locking member to prevent the movement of the tubular member.

Figure 6:
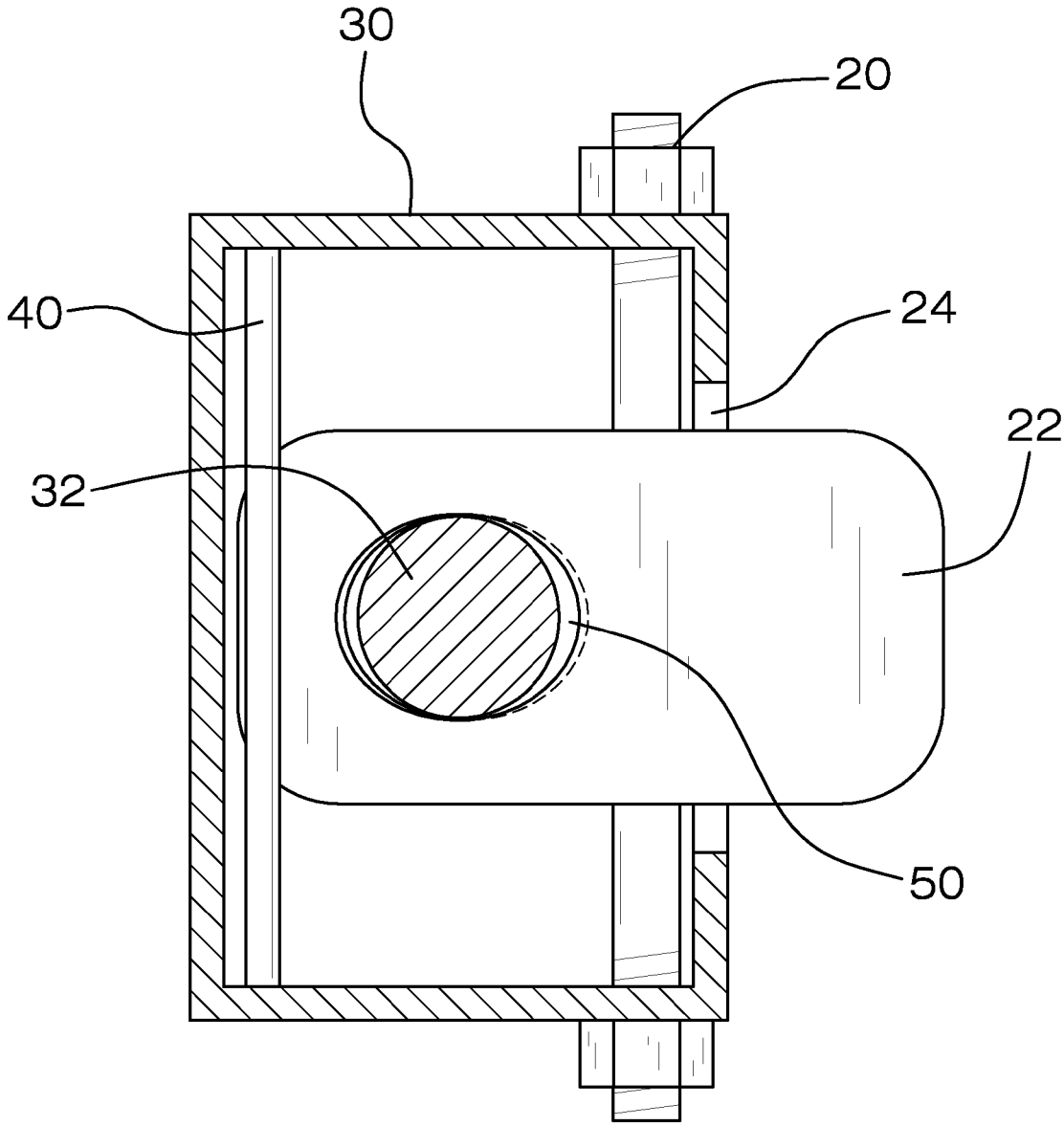
FIG. 6 shows a horizontal cross-section of one embodiment of the device of the present invention.

FIG. 6 shows a cross section of the leg assembly at the position of the locking member. Shown are the locking member 24, the opening in the outer member 22, the outer member 30, the pivot point 20, the tubular member 32, the optional stop 40 and the elliptical hole 50 in the locking member.

Figure 7A:
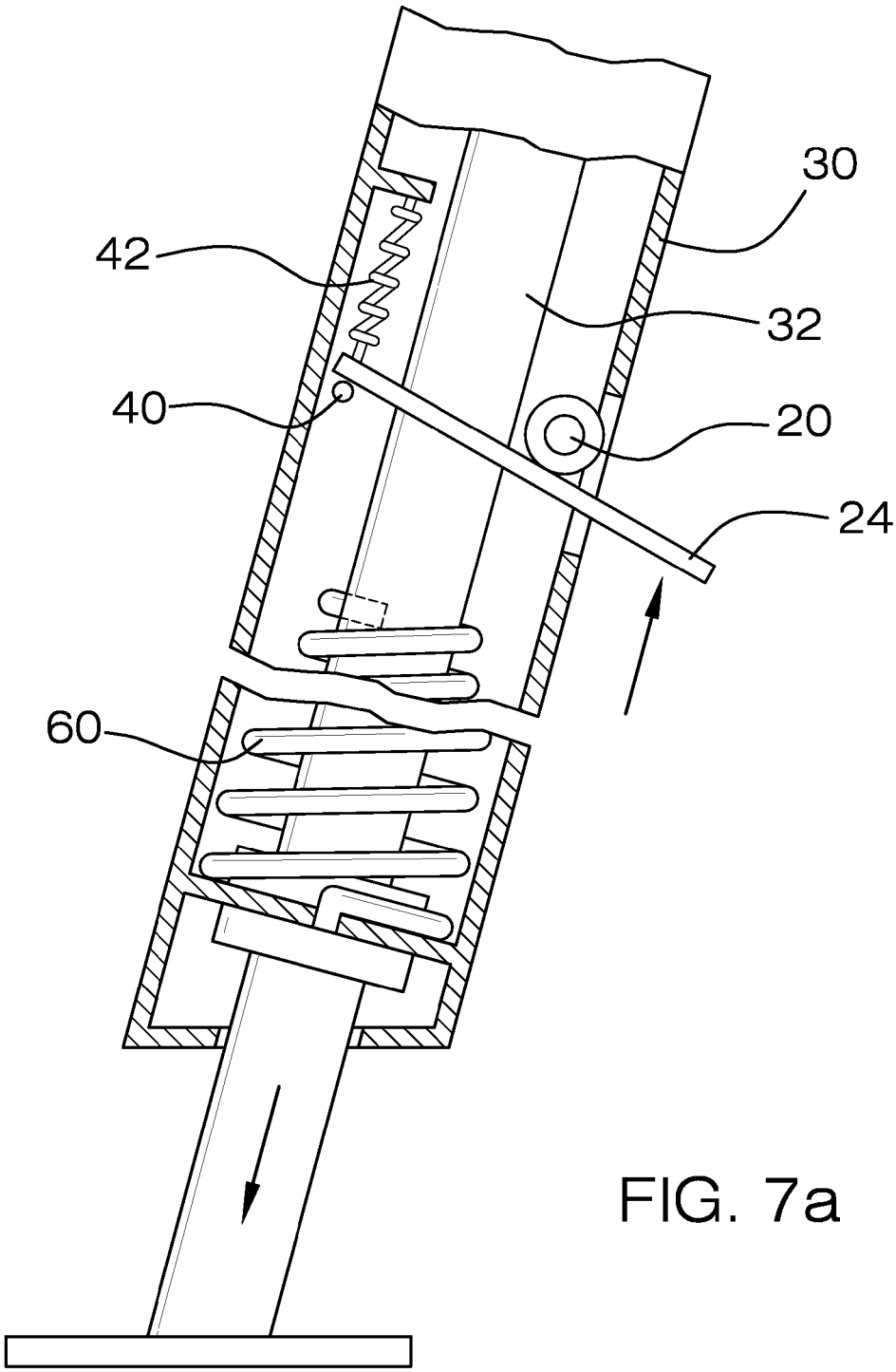
FIG. 7*a* shows user applied force to the locking member 24 for achieving an extended configuration.
Figure 7B:
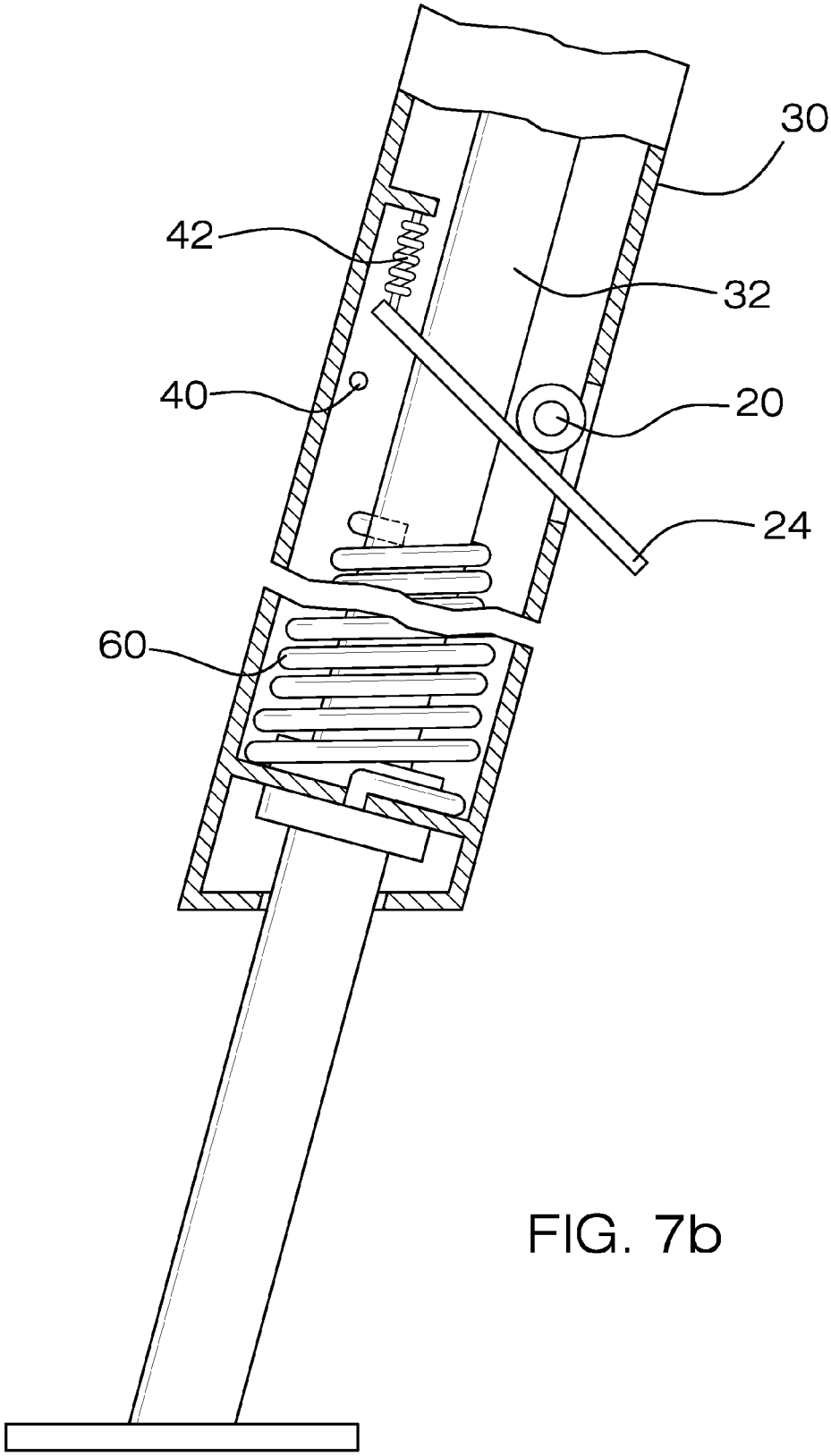
FIG. 7*b* shows the assembly in an extended configuration.

FIG. 7 shows one embodiment of a mechanism designed to aid in the extension of the tubular 32 member from the outer member 30 upon depressing locking member 24. In this embodiment, assist spring 60 compresses upon depressing the locking member 24 causing the tubular member 32 to be extended out of the outer member 30. FIG. 7*a* shows to retract the tubular member 32 into the outer member 30, the locking member 24 is depressed and pressure is applied the foot assembly 35 forcing the tubular member 32 into the outer member 30. When the user releases the locking member 24 when either extending the tubular member 32 from the outer member 30 leg assembly or retracting the tubular member 32 into the outer member 30 of the leg assembly the length of the leg assembly is maintained as shown in FIG. 7*b*. One of skill in the art would understand after learning the teachings of the present invention that the assist spring may be designed to pull the tubular member into the outer member and user force would be need to extend the tubular member out of the outer member.

What is claimed is:

1. A leg-length adjustment assembly comprising:

a. an outer member comprising an inner surface and one or more openings in the wall of the outer member said opening comprising upper, lower and side edges;

b. an inner tubular member disposed within said outer member wherein said inner tubular member does not come into contact with said outer member;

c. a single pivotal locking member having an outer end, an inner end, said inner end terminating internal to the outer member, and a pivot point, wherein said inner tubular member passes through an elliptical hole comprising an edge in the pivotal locking member, wherein said outer end of said locking member extends through the opening of said outer member, and wherein said pivot point of the pivotal locking member is a pivot located within said outer member proximal to the upper edge of said opening;

d. a spring having a first end and a second end, said first end attached at an attachment point at the inner end of said locking member and the second end attached to an attachment point located on the inner surface of the outer member;

e. wherein when said outer end of said pivotal locking member is raised the spring is expanded, the pivotal locking member is pivoted on said pivot, the elliptical hole in said pivotal locking member is positioned such that it is essentially perpendicular to said inner tubular member thereby allowing said inner tubular member to freely pass through said elliptical hole of the locking member, and f. wherein when said outer end of said pivotal locking member is released, the spring contracts, the pivotal locking member is pivoted on said pivot, the elliptical hole in said locking member is positioned such that it is at an angle to said tubular member and the edges of said elliptical hole at least partially contacts said inner tubular member thereby preventing the movement of the inner tubular member through the elliptical hole of the locking member.

2. The assembly of claim 1, wherein guides for said inner tubular member are positioned within said outer member and wherein said position is selected from one or more of below and above said pivotal locking member.

3. The assembly of claim 2, wherein said guides comprise bushings and said bushings contact said tubular member.

4. The assembly of claim 3, wherein said bushings comprise neoprene.

5. An adjustable ladder comprising a plurality of leg assemblies selected from the group consisting of two legs and four legs, wherein each leg assembly comprises the leg extension assembly of claim 1.

6. The adjustable ladder of claim 5 wherein each leg assembly additionally comprises a pivotal foot.

7. The adjustable ladder of claim 6, wherein each pivotal foot comprises a bottom surface and a non-slip surface on said bottom surface.

8. The adjustable ladder of claim 5, wherein said ladder comprises materials selected from the group consisting of metal, plastic, rubber and wood.

9. The adjustable ladder of claim 5, wherein said ladder additionally comprises one or more means to level said ladder.

10. The leg-length adjustment assembly of claim 1, further comprising: one or more extending springs for extending said inner tubular member, each extending spring comprising a first end and a second end wherein said first end is attached to the inner tubular member below said pivotal locking member and said second end is attached to the inside of said outer member proximal to the lowest end of said outer member, wherein when the outer end of said pivotal locking member is raised, said extending spring contracts thereby causing the inner tubular member to slidably extend from said outer member, and when the outer end of said pivotal locking member is raised and upward pressure is applied to a foot on said inner tubular member, the inner tubular member is caused to slidably insert further into said outer member.

11. An adjustable ladder comprising:

a. two or more leg-length adjustment assemblies comprising:

i. an outer member comprising an inner surface and one or more openings in the wall of the outer member said opening comprising upper, lower and side edges;

ii. an inner tubular member disposed within said outer member wherein said inner tubular member does not come into contact with said outer member;

iii. a single pivotal locking member having an outer end, an inner end~said inner end terminating internal to the outer tubular member, and a pivot point, wherein said inner tubular member passes through an elliptical hole comprising an edge in the pivotal locking member, wherein said outer end of said locking member extends through the opening of said outer member, and wherein said pivot point of the pivotal locking member is a pivot located within said outer member proximal to the upper edge of said opening of said opening;

iv. a spring having a first end and a second end, said first end attached at an attachment point at the inner end of said locking member and the second end attached to an attachment point located on the inner surface of the outer member;

v. wherein when said outer end of said pivotal locking member is raised the spring is expanded, the pivotal locking member is pivoted on said pivot, the elliptical hole in said pivotal locking member is positioned such that it is essentially perpendicular to said inner tubular member thereby allowing said inner tubular member to freely pass through said elliptical hole of the locking member, and vi. wherein when said outer end of said pivotal locking member is released, the spring contracts, the pivotal locking member is pivoted on said pivot, the elliptical hole in said locking member is positioned such that it is at an angle to said inner tubular member and the edges of said elliptical hole at least partially contacts said inner tubular member thereby preventing the movement of the tubular member through the elliptical hole of the locking member;

b. wherein said leg-length adjustment assembly further comprises one or more extending springs for extending said inner tubular member, each extending spring comprising a first end and a second end wherein said first end is attached to the inner tubular member below said pivotal locking member and said second end is attached to the inside of said outer member proximal to the lowest end of said outer member, wherein when the outer end of said pivotal locking member is raised, said extending spring contracts thereby causing the inner tubular member to slidably extend from said outer member, and when the outer end of said pivotal locking member is raised and upward pressure is applied to a foot on said inner tubular member, the inner tubular member is caused to slidably insert further into said outer member;

c. wherein the foot comprises a pivotal foot wherein said pivotal foot comprises a bottom surface and a non-slip surface on said bottom surface; and d. wherein said adjustable ladder additionally comprises one or more means to determine if said ladder is level.

12. The adjustable ladder of claim 11, wherein guides for said inner tubular member are positioned within said outer member and wherein said position is selected form one or more of below and above said pivotal locking member.

13. The adjustable ladder of claim 12, wherein said guides comprise bushings and said inner bushings contact said tubular member.

14. The adjustable ladder of claim 13, wherein said bushings comprise neoprene.

15. The adjustable ladder of claim 11, wherein said ladder comprises materials selected from the group consisting of metal, plastic, rubber and wood.

* * * * *